US005551996A

United States Patent [19]

Adachi et al.

[11] Patent Number: 5,551,996

[45] Date of Patent: Sep. 3, 1996

[54] SI-CONTAINING MAGNESIUM ALLOY FOR CASTING WITH MELT THEREOF

[75] Inventors: Mitsuru Adachi; Satoru Sato; Hiroto Sasaki, all of Ube, Japan

[73] Assignee: Ube Industries, Ltd., Yamaguchi, Japan

[21] Appl. No.: 219,355

[22] Filed: Mar. 29, 1994

[30] Foreign Application Priority Data

Mar. 30, 1993 [JP] Japan ..... 5-071977
Oct. 7, 1993 [JP] Japan ..... 5-251868

[51] Int. Cl.[6] ..... C22C 23/02; C22C 23/04

[52] U.S. Cl. ..... 148/420; 420/408; 420/409

[58] Field of Search ..... 420/407, 408, 420/409, 410; 148/420; C22C 23/02, 04

[56] References Cited

U.S. PATENT DOCUMENTS 5,143,564 9/1992 Gruzleski et al. ..... 420/409

*Primary Examiner*—Donald E. Czaja
*Assistant Examiner*—Sean Vincent
*Attorney, Agent, or Firm*—Finnegan, Henderson, Farabow, Garrett & Dunner, L.L.P.

[57] ABSTRACT

A—Si containing magnesium alloy for casting with a melt thereof with a cast structure having eutectic compounds of $Mg_2Si$ produced to improve creep strength of a cast product, preferably a Si-containing magnesium alloy of a Mg—Al—Zn system having either 0.01% to 2.0% or 6 to 12% of Zn and 6 to 12% of Al, is disclosed with the improvement in that the alloy contains 0.3 to 1.5% by weight of Si in combination with 0.005 to 0.2% of Sr added to effect refinement of the eutectic compounds to thereby reduce hot cracking and improve mechanical properties of the cast product, while the improved creep strength is preserved.

6 Claims, 4 Drawing Sheets

SI-CONTAINING MAGNESIUM ALLOY FOR CASTING WITH MELT THEREOF

BACKGROUND OF THE INVENTION

1. Field of the Invention

The present invention relates to an improved Si-containing magnesium alloy for pressure casting or gravity casting with a melt of the alloy.

2. Description of the Related Art

In a wide sense, a method of casting an alloy includes casting with a melt of the alloy and casting with rapidly solidified particles or the like of the alloy. The melt alloy casting method includes pressure casting such as high or low pressure die casting and squeeze casting. The rapidly solidified alloy casting comprises the steps of rapidly solidifying a melt of the alloy to produce alloy particles or the like, and consolidating the particles by compacting.

With respect to the rapidly solidified alloy casting method, it has been recognized that there is no serious problem in castability, particularly hot cracking, since the two above mentioned steps in combination prevent such hot cracking from occurring, whereas the melt alloy casting inherently encounters such a problem, since the melt is solidified in a single casting step to form a cast product.

One of the known typical magnesium alloys for casting is AZ91, and it has been recognized as having superior mechanical properties and castability when it is used for gravity casting, particularly AZ91 is known as a magnesium alloy having a system of aluminum and zinc exhibiting less hot crack sensitivity in the gravity casting.

For pressure casting, such a Mg—Al—Zn system alloy as AZ91 has been modified by adding Si to diminish or reduce hot cracking and also improve creep strength. However, in the case of a die cast or squeeze cast product with a large variation in thickness, the addition of Si cannot prevent substantial occurrence of hot cracking, particularly in the case of the squeeze cast product.

Further, it is noted that a Si-containing cast product having a portion where a cooling rate during solidification is relatively low has coarse granular eutectic compounds of $Mg_2Si$ produced, which have a detrimental effect on mechanical properties of the cast product.

In connection with the above, it is noted that JP-A63-220961 discloses a Si-containing magnesium alloy for die casting consisting of 3.7–4.8 wt % of Al, 0.22–0.48 wt % of Mm, 0.69 to 1.4 wt % of Si and the balance of Mg and impurities, wherein the addition of Si is recognized as reducing gas porosity and exterior shrinkage porosity.

JP-A63-220962 discloses a Si-containing magnesium alloy for porosity-free casting of a product having a complicated profile, at a die temperature of 100° to 150° C. The alloy has the same composition as that of JP-A63-220961. The reference states that Si improves a creep property of the cast alloy at a high temperature and prevents occurrence of cast cracking, and it is necessary to add not less than 0.69% of Si to obtain these effects, while over 1.4% of Si is prone to hot cracking as well as exterior shrinkage.

U.S. Pat. No. 5,147,603 relates to the above mentioned rapidly solidified alloy casting, and discloses a Si-containing magnesium alloy consisting, by weight %, of 2–11% of Al,0–1% of Mn, and 0.1–6% of Sr with the following content of the main impurities: Si<0.6%; Cu<0.2%; Fe<0.1%; and Ni<0.01%, the remainder being Mg. It is noted in the reference that Si may exist as an impurity. This means that Si is not an essential element to be added. Sr is added to improve mechanical properties of alloy, particularly to obtain a high breaking strength or high load at rupture exceeding 400 MPa.

A report given at the 96th AFS Casting Congress, entitled "Effect of Strontium on the Shrinkage Microporosity in Magnesium Sand Castings", by C. A. Aliravci, J. E. Gruzleski, F. C. Dimayuga, May 3–7, 1992 (American Foundations Society Inc.) states, in conclusion, that: Sr has a strong effect on the distribution of shrinkage microporosity of AZ91C alloy castings; additions of up to 0.02% of Sr trend to concentrate shrinkage microporosity at the hottest section while minimizing it in the rest of the castings; the optimum level of Sr addition that promotes this effect was found to be between 0.01% and 0.02% of Sr, whereas with additions made both above and below this range the effect rapidly disappears; thermal analysis showed that the addition and dissolution of Sr alters the grain size in AZ91C alloy melt; and the SEM-based grain size analysis technique verified that the addition of 0.01% to 0.02% of Sr produces a fine grain size of 120 μm while castings with no Sr have a coarser grain size of 250 μm.

In connection with the above report, it should be noted that AZ91C consists of, by weight %, 8.1–9.3% of Al, >0.13% of Mn, 0.4–1.0% of Zn, <0.30% of Si, <0.10% of Cu, <0.01% of Ni, and the balance of Mg with impurities.

Another report given at the Magnesium International Congress, 1992 by B. L. Mordike and F. Hehmann Editors, entitled "Magnesium Alloys and Their Applications" states, in conclusion, that: addition of Sr to AZ91 magnesium alloy, and probably to all Mg-Al based conventional cast alloys, results in a better castability, but the amount of Sr necessary to produce such changes seems to depend upon the casting conditions; in the casting conditions used in this work, cast parts of AZ91+0.3% Sr with considerably reduced microporosity were obtained, without significant loss in strength or ductility at room temperature; the presence of Sr at these levels also seems to induce better creep properties and improved performance in accelerated corrosion tests; and an explanation for these observed changes in alloy performance has been proposed in terms of the microstructure changes in the presence of Sr: grain refinement and new Sr containing needle-shaped precipitates. However, the present inventor has found from the data given in the above report that the presence of Sr does not seem to induce better creep properties contrary to the above conclusion.

With respect to the Mg—Al—Zn ternary system cast alloys, there are two reports to be noted, entitled "Investigation Regarding Magnesium Die Cast" by G. S. Foerster, Dr. P. C. J. Gallagher, D. L. Hawke and Dr. E. N. Aqno (Die Casting Engineer, 1–2, 1977), and "Properties of Mg—Al—Zn Ternary Cast Alloys" by H. Ishimaru, J. Kaneko and M. Sugamata (the 58th Spring Congress of Light Metal Academy in Japan, 1980).

The first report (Foerster et al) illustratively teaches in a binary Al—Zn system diagram of the magnesium cast alloy (FIG. 2) that: hot cracking does not occur and thus the alloy is castable in a zone having less than about 1.5 wt % of Zn, irrespective of the content of Al; the alloy is castable, for example, in a zone having more than about 6.0 wt % of Zn and more than about 2.5 wt % of A1; the alloy is castable, for example, in a zone having more than about 4.0 wt % of Zn and more than about 6.0 wt % of A1; and the alloy is not castable in at least a zone having less than about 5.0 wt % of Zn and less than about 4.0 wt % of Al .

The second report (Ishimaru et al) also illustratively teaches in a corresponding binary Al—Zn system diagram of the magnesium cast alloy (FIG. 6) that: hot cracking does not occur in a zone having less than about 2.0 wt % of Zn, irrespective of the content of Al; it does not occur, for example, in a zone having more than about 6.0 wt % of Zn and more than about 8.0 wt % of Al; it does not occur, for example, in a zone having more than about 8.0 wt % of Zn and more than about 6.0 wt % of Al; and it occurs in at least a zone having 2.0 to 6.0 wt % of Zn and less than 8.0 wt % of Al.

SUMMARY OF THE INVENTION

An object of the present invention is to provide a less hot crack sensitive magnesium alloy for casting with a melt thereof, exhibiting superior creep properties and mechanical properties, particularly a magnesium alloy capable of considerably reducing hot cracking even in high pressure-casting to form a cast product having a large variation in thickness.

Another object of the present invention is to provide improved magnesium alloys for high pressure casting, low pressure casting and gravity casting.

According to the present invention, the less hot crack sensitive magnesium alloy is a Si-containing alloy with a cast structure having eutectic compounds of $Mg_2Si$ produced to improve creep strength of a cast product, characterized in that the alloy contains, by weight %, 0.3 to 1.5% of Si in combination with 0.005 to 0.2% of Sr added to effect refinement of the eutectic compounds to thereby reduce hot cracking and improve mechanical properties of the cast product, while the improved creep strength is preserved.

Preferably, the alloy forms a Mg—Al—Zn system with 6 to 12% of Al and 0.01 to 2.0% of Zn for either pressure (high or low) casting or gravity casting, or with 6 to 12% of Al and 6 to 12% of Zn for high pressure.

The alloy of the present invention has a high creep strength, a high castability due to reduction of hot cracking, with improved mechanical properties: proof stress, ultimate tensile strength and elongation.

EMBODIMENTS

EXAMPLE 1

Figure 1:
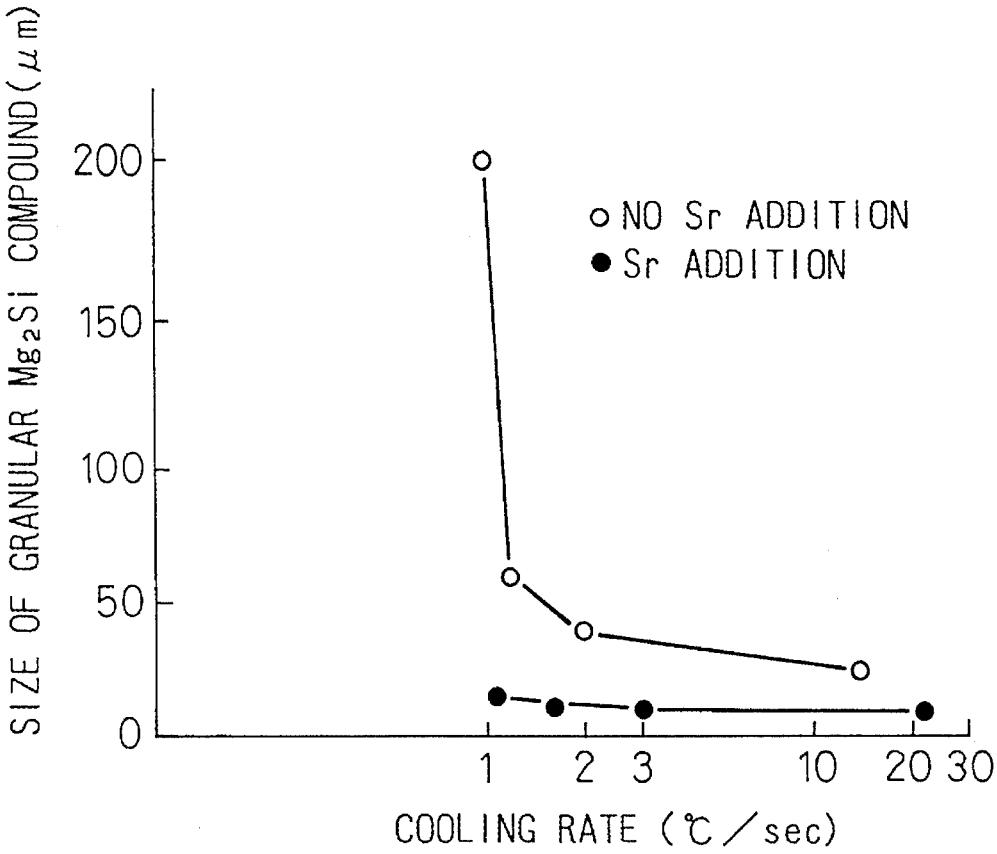
FIG. 1 is a diagram showing sizes of $Mg_2Si$ compounds produced in cast magnesium alloys with Sr added and with no Sr added versus cooling rates during the casting processes.

Two kinds of alloys of Mg-7%Al-1%Zn-0.8%Si-0.4%Mn with Sr added and with no Sr added were gravity-cast with various cooling rates, in order to study possible influences of the cooling rates and Sr on sizes of $Mg_2Si$ compounds produced in the structure of the cast alloys. The sizes of the compounds were determined at various cooling rates which were measured at temperatures ranging from 600° to 420° C. The results are indicated in FIG. 1. From FIG. 1, it can be recognized that the alloy with no Sr added has granular $Mg_2Si$ compounds produced with a size increasing as the cooling rate decreases, and the size is increased up to 200 μm at a cooling rate of 1° C./sec. The other alloy with 0.05% of Sr added has granular $Mg_2Si$ compounds produced with a size of 10 to 15 μm, which does not substantially vary as the cooling rate decreases. This test is useful in order to confirm that addition of Sr contributes to grain refinement of $Mg_2Si$ compounds in various cast processes such as sand gravity casting with a normal cooling rate of not more than 1° C./sec, metal gravity casting with a normal cooling rate of 1° to 5° C./sec, squeeze casting with a normal rate of about 10° C./sec and die casting with a normal cooling rate of 20° to 30° C./sec.

Figure 2:
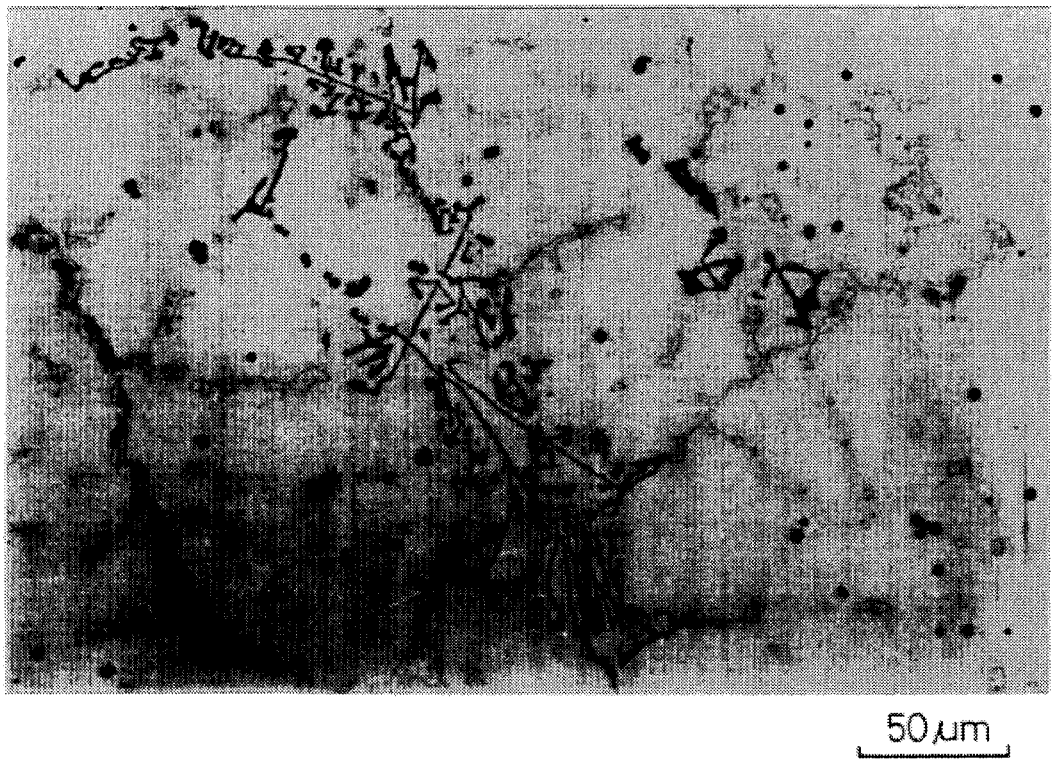
FIG. 2 is a photomicrograph showing a structure of a magnesium alloy with no Sr added.
Figure 3:
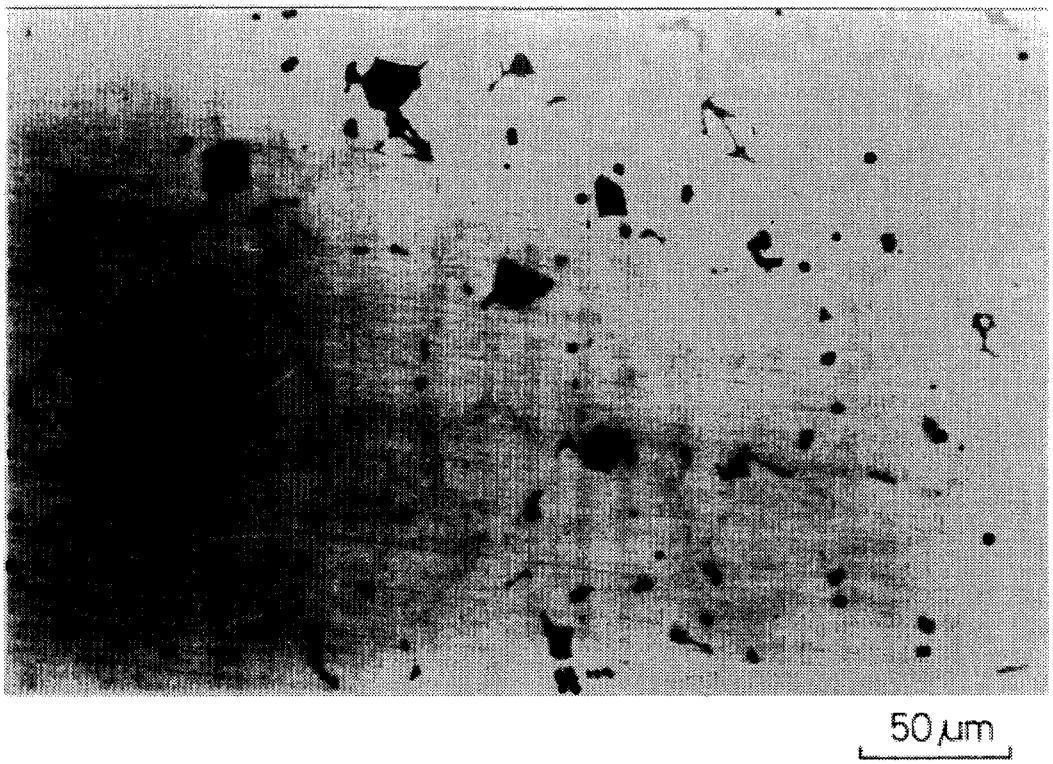
FIG. 3 is another photomicrograph showing a structure of as magnesium alloy with Sr added.

From FIG. 2, it is recognized that the alloy with no Sr added has several coarse granular compounds of $Mg_2Si$, and from FIG. 3 it is recognized that the alloy with Sr added has fine granular compounds of $Mg_2Si$ of a polygonal shape dispersed.

EXAMPLE 2

Figure 5:
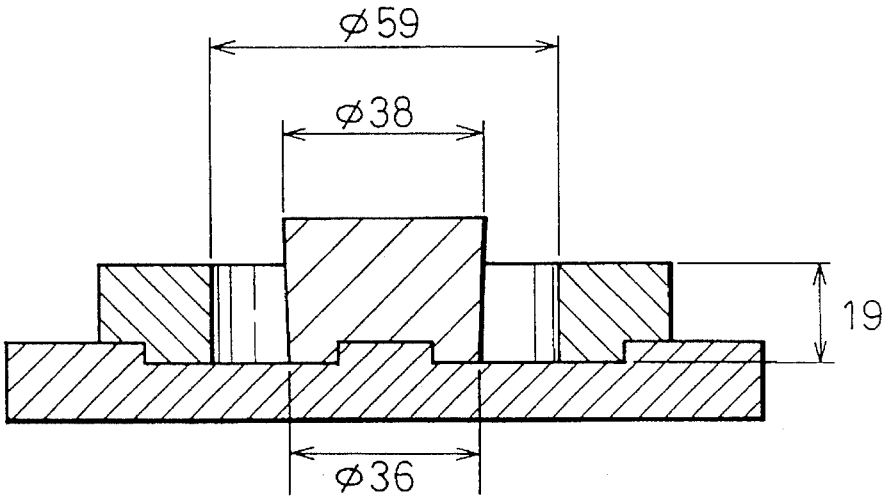
FIG. 5 is a sectional view of a mold for a ring test.

Table 1 indicates compositions of test alloys by weight %. Test alloys No. 1 to No. 5 are alloys of the present invention, while test alloys No. 6 to No. 10 are comparative alloys. A hot cracking test was carried out for test pieces of alloys No. 1 to No. 10 which were gravity-cast in a ring mold as shown in FIG. 5. An average length of hot cracks generated in each test piece was measured, and the results are indicated in Table 1.

Further, in order to determine creep strength of each cast alloy, the following examination was made:

The same test alloys No. 1 to No. 10 were gravity-cast to form plate pieces having a profile with a thickness of 10 mm, a width of 70 mm and a length of 120 mm. Each plate piece had a through-hole produced, and was clamped by a combination of a bolt and nut therebetween, at the hole through which the bolt extends, with a given nut torque of 200 ekgf.cm about the bolt. The clamped plate piece was subjected to a heat treatment at 150° C. for 96 hours and then cooled to room temperature with the result that a clamping force of the bolt-nut against the plate piece was reduced whereby the nut torque was changed to a lower level a due to the inherent creep strength of the cast alloy. As a measure of the creep strength, adopted was a torque reduction rate X represented by the following formula:

$$X(\%) = 100\left(1 - \frac{a}{200}\right)$$

The results of the creep strength test are indicated in Table 1.

TABLE 1

| | No. | Al | Zn | Si | Mn | Sr | Mg | Hot Crack Length (mm) | Torque Reduction Rate (%) X |
|---|---|---|---|---|---|---|---|---|---|
| Inventive Alloys | 1 | 7.1 | 0.9 | 1.1 | 0.40 | 0.05 | Balance | 15 | 10 |
| | 2 | 6.8 | 1.0 | 1.4 | 0.35 | 0.01 | " | 14 | 9 |
| | 3 | 9.0 | 1.0 | 1.1 | 0.35 | 0.03 | " | 8 | 12 |
| | 4 | 7.0 | 0.9 | 0.8 | 0.38 | 0.2 | " | 13 | 10 |
| | 5 | 9.0 | 1.0 | 0.5 | 0.35 | 0.04 | " | 10 | 12 |
| Comparative Alloys | 6 | 7.1 | 0.8 | 0.8 | 0.40 | 0.002 | Balance | 30 | 10 |
| | 7 | 6.9 | 1.0 | 1.6 | 0.35 | 0.05 | " | 15 | 9 |
| | 8 | 9.0 | 1.1 | 0.1 | 0.27 | 0.001 | " | 15 | 38 |
| | 9 | 6.8 | 0.9 | 2.5 | 0.25 | 0.3 | " | 12 | 9 |
| | 10 | 7.0 | 0.9 | 0.8 | 0.40 | 0.5 | " | 20 | 10 |

Note: Each alloy further contains the balance of Mg.

Figure 6:
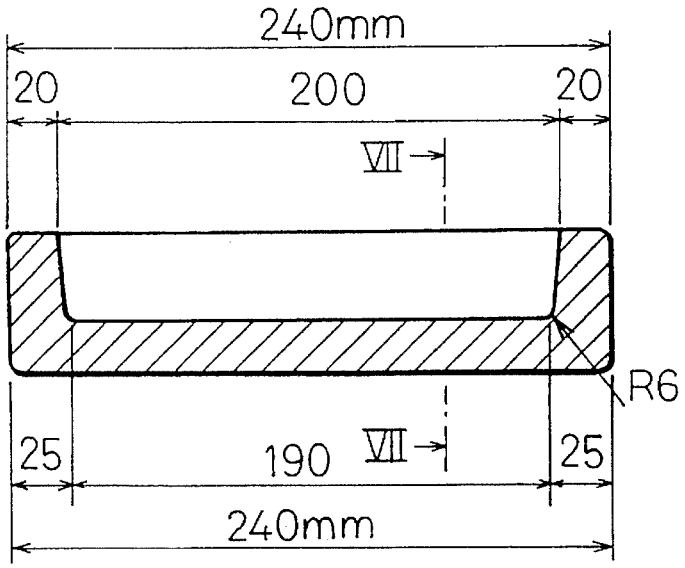
FIG. 6 is a sectional view of a mold for JIS cast test pieces.
Figure 7:
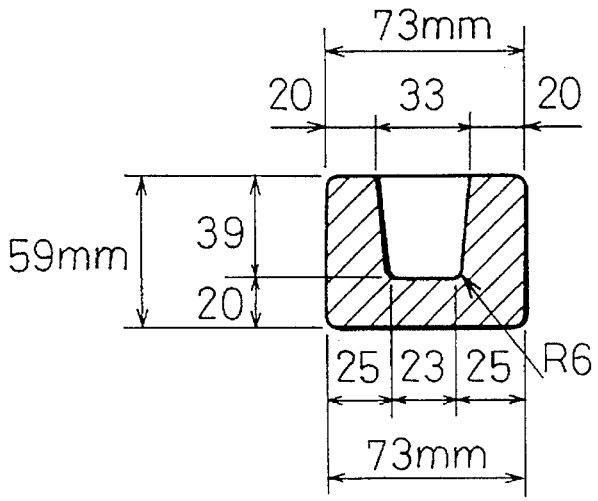
FIG. 7 is a sectional view of the mold taken along line VII—VII in FIG. 6.

Still further, additional test pieces of the test alloys No. 1 to No. 10 were gravity-cast in a JIS boat type mold (JIS H5203) as shown in FIGS. 6 and 7° at 300° C. to determine ultimate tensile strength and elongation of the cast alloy. The results are indicated in Table 2.

TABLE 2

| | No. | Ultimate Tensile Strength (MPa) | Elongation (%) |
|---|---|---|---|
| Inventive Alloys | 1 | 265 | 2 |
| | 2 | 262 | 2 |
| | 3 | 270 | 2 |
| | 4 | 260 | 3 |
| | 5 | 266 | 2 |
| Comparative Alloys | 6 | 190 | 1 |
| | 7 | 160 | 0.5 |
| | 8 | 240 | 3 |
| | 9 | 145 | 0.5 |
| | 10 | 220 | 2 |

EXAMPLE 3

Figure 4:
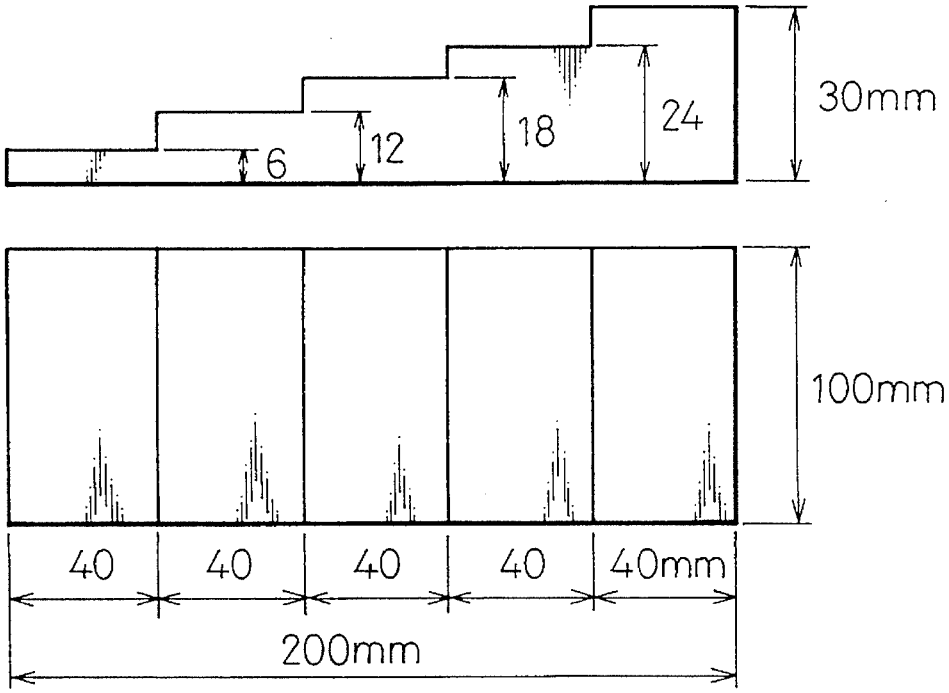
FIG. 4 is a combination of a top view and a side view showing a profile of test pieces of cast alloys.

Test alloys of a Mg—Al—Zn system No. 1 to No. 4 of the present invention and No. 5 to No. 11 as comparative alloys as shown in Table 3 were squeeze-casted in a mold to form stepwise cast pieces having a profile as shown in FIG. 4 under the following cast conditions:

Metal temperature: 720° C.

Injection speed: 0.1 m/sec

Metal pressure : 90 MPa

The test pieces were measured, using a profile projector to determine lengths of hot cracks generated at round step corners of the test pieces.

Further, the same test alloys No. 1 to No. 10 were gravity-cast to form plate pieces having a profile with a thickness of 10 mm, a width of 70 mm and a length of 120 mm. Each plate piece was subjected to the same creep strength test as that of Example 2. The results are indicated in Table 3.

TABLE 3

| | No. | Al | Zn | Si | Mn | Sr | Mg | Hot Crack Length (mm) | Torque Reduction Rate (%) X |
|---|---|---|---|---|---|---|---|---|---|
| Inventive Alloys | 1 | 9 | 0.8 | 0.4 | 0.03 | 0.2 | 0.001 | 50 | 12 |
| | 2 | 9 | 0.8 | 0.8 | 0.05 | 0.2 | 0.001 | 44 | 10 |
| | 3 | 11 | 1 | 0.8 | 0.05 | 0.2 | 0.001 | 32 | 15 |
| | 4 | 7 | 1 | 0.8 | 0.05 | 0.2 | 0.001 | 64 | 10 |
| | 5 | 9 | 0.8 | | | 0.2 | 0.001 | 211 | 37 |
| Comparative Alloys | 6 | 9 | 0.8 | 0.4 | | 0.2 | 0.001 | 175 | 13 |
| | 7 | 9 | 0.8 | 0.8 | | 0.2 | 0.001 | 141 | 10 |
| | 8 | 9 | 0.8 | | 0.03 | 0.2 | 0.001 | 127 | 35 |

TABLE 3-continued

| No. | Al | Zn | Si | Mn | Sr | Mg | Hot Crack Length (mm) | Torque Reduction Rate (%) X |
|---|---|---|---|---|---|---|---|---|
| 9 | 9 | 0.8 | | 0.06 | 0.2 | 0.001 | 110 | 35 |
| 10 | 4 | 1 | 0.8 | 0.05 | 0.2 | 0.001 | 297 | 8 |
| 11 | 14 | 1 | 0.8 | 0.05 | 0.2 | 0.001 | 80 | 17 |

Note: Each alloy further contains the balance of Mg.

EXAMPLE 4

Another group of test alloys No. 12 to No. 20 were squeeze-casted according to the same procedure and conditions as those of Example 3. The resultant stepwise test pieces were subjected to T4 solution treatment (415° C., 20 hr) at respective step portions having a thickness of 12 mm, and then tensile tests of the treated pieces were made to determine mechanical properties of the cast alloys: ultimate tensile strength; proof stress; and elongation.

Further, the heat treated pieces were observed under a microscope to determine the sizes of the $Mg_2Si$ compounds produced in the structures of the cast alloys.

The compositions of the test alloys and the results are indicated in Table 4.

TABLE 4

| | No. | Al | Zn | Si | Sr | Ultimate Tensile Strength (MPa) | Proof Stress (MPa) | Elongation (%) | $Mg_2Si$ Compound |
|---|---|---|---|---|---|---|---|---|---|
| Inventive Alloys | 12 | 9 | 0.8 | 0.4 | 0.03 | 269 | 110 | 9.0 | fine |
| | 13 | 9 | | 0.4 | 0.03 | 281 | 103 | 14.3 | fine |
| | 14 | 9 | 1 | 0.8 | 0.02 | 260 | 114 | 9.4 | fine |
| Comparative Alloys | 15 | 9 | 0.8 | | | 246 | 103 | 9.0 | — |
| | 16 | 9 | 0.8 | 0.4 | | 228 | 108 | 5.3 | coarse |
| | 17 | 9 | 0.8 | | 0.03 | 273 | 113 | 11.3 | — |
| | 18 | 9 | | | | 242 | 102 | 8.6 | — |
| | 19 | 4 | 1 | 0.8 | 0.05 | 247 | 91 | 7.4 | fine |
| | 20 | 14 | 1 | 0.8 | 0.05 | 229 | 132 | 2.7 | fine |

Note: Each alloy further contains 0.2% of Mn, 0.001% of Be and the balance of Mg.

EXAMPLE 5

Table 5 indicates compositions of test alloys No. 1 to 4 of the present invention and No. 5 to No. 8 as comparative alloys. The test alloys were pressure-casted to form stepwise test pieces according to the same procedure and conditions as those of EXAMPLE 3 or 4. The test pieces were examined by the same test procedures as those of EXAMPLE 3 and 4 to determine the average lengths of hot cracks, the torque reduction rate and the sizes of the $Mg_2Si$ compounds. The results are indicated in Table 5.

TABLE 5

| | No. | Al | Zn | Si | Sr | Hot Crack Length (mm) | Torque Reduction Rate (%) X | $Mg_2Si$ Compound |
|---|---|---|---|---|---|---|---|---|
| Inventive Alloys | 1 | 8.1 | 8.1 | 0.9 | 0.03 | 44 | 13 | fine |
| | 2 | 12.0 | 8.0 | 0.4 | 0.03 | 38 | 13 | fine |
| | 3 | 12.0 | 6.0 | 0.8 | 0.03 | 40 | 10 | fine |
| | 4 | 6.0 | 6.0 | 0.8 | 0.03 | 60 | 10 | fine |
| Comparative Alloys | 5 | 9.0 | 0.8 | — | — | 211 | 35 | — |
| | 6 | 8.1 | 8.1 | — | — | 46 | 38 | — |
| | 7 | 8.1 | 8.1 | 0.4 | — | 45 | 15 | coarse |
| | 8 | 8.0 | 5.0 | 0.9 | 0.03 | 96 | 14 | fine |

Note: Each alloy further contains 0.2% of Mn, 0.001% of Be and the balance of Mg.

EXAMPLE 6

Test alloys No. 1 to No. 4 of the present invention and No. 5 to No. 10 as comparative alloy having compositions as indicated in Table 6 were low pressure-casted and subjected to examinations similar to those of Examples 1 to 3 to determine the average lengths of hot cracks, creep strengths (torque reduction rates) and mechanical properties (ultimate tensile strength and elongation). The results are indicated in Table 6.

TABLE 6

| | No. | Al | Zn | Si | Sr | Be (ppm) | Ultimate Tensile Strength (MPa) | Elonga-tion (%) | Torque Reduction Rate (%) X | Hot Crack Length (mm) |
|---|---|---|---|---|---|---|---|---|---|---|
| Inventive Alloys | 1 | 9.0 | 0.7 | 0.4 | 0.02 | 5 | 260 | 5.6 | 12 | 5 |
| | 2 | 9.0 | 0.01 | 0.5 | 0.03 | 4 | 264 | 8.0 | 12 | 3 |
| | 3 | 8.5 | 0.7 | 0.7 | 0.02 | 4 | 255 | 7.0 | 10 | 15 |
| | 4 | 10.0 | 0.8 | 0.4 | 0.03 | 5 | 265 | 5.0 | 10 | 5 |
| Compar-ative Alloys | 5 | 9.0 | 0.7 | — | — | 5 | 235 | 6.5 | 35 | 10 |
| | 6 | 9.0 | 0.7 | 0.4 | — | 5 | 230 | 4.0 | 13 | 8 |
| | 7 | 9.0 | 0.7 | — | 0.02 | 5 | 259 | 8.4 | 35 | 5 |
| | 8 | 5.0 | 0.7 | 0.4 | 0.02 | 5 | 210 | 9.2 | 13 | 40 |
| | 9 | 9.0 | — | 2.0 | 0.03 | 5 | 205 | 1.0 | 10 | 5 |
| | 10 | 13.0 | 0.8 | 0.4 | 0.03 | 5 | 201 | 0.8 | 11 | 3 |

Note: Each alloy further contains 0.20% of Mn and the balance of Mg.

As being apparent from the comparative data indicated in Tables 1 to 6, the alloys according to the present invention have a reduced hot crack sensitivity leading to a better castability with an increased creep strength and improved mechanical properties, when they are applied to pressure casting and gravity casting.

According to the present invention, the content of Al may be 6 to 12% by weight. This is because less than 6% of Al is prone to hot cracking, while more than 12% of Al damages mechanical properties although it is still as effective as the 6 to 12% content in reducing the hot cracking. The content of Zn may be 0.01 to 2.0% by weight or 6.0 to 12.0% by weight in order to reduce the hot cracking, for the reason that less than 0.01% of Zn and more than 12.0% of Zn do not exhibit a positive effect on the reduction of the hot cracking, and a range of Zn between 2.0 and 6.0% has a negative effect on the reduction of the hot cracking.

The content of Si may be 0.3 to 1.5% by weight in order to enhance the creep strength. This is because less than 0.3% of Si does not exhibit a positive effect on the creep strength, and addition of Sr does not cause the $Mg_2Si$ compounds to be refined when the content of Si is over 1.5% with the result that the mechanical properties are damaged.

The content of Sr may be 0.005 to 0.2% by weight in order to refine the $Mg_2Si$ compounds, because less than 0.005% and over 0.2% of Sr do not exhibit a positive effect on the refinement of the compounds. Preferably, the content of Sr may be not more than 0.1% by weight.

With respect to other components to be added in the magnesium alloy of the present invention, a small amount of Mn is preferable to improve corrosion resistance of the cast alloy with an inevitable impurity of Fe, and a small amount of Be is preferable to prevent oxidation of molten magnesium.

We claim:

1. A Si-containing magnesium alloy for high pressure casting from a melt thereof to produce a cast alloy part with reduced hot cracking, comprising 6 to 12% by weight of aluminum, 0.3 to 1.5% by weight of silicon, from more than 0.1 to 0.2% by weight of strontium, and 0.01 to 2.0% by weight of zinc, the balance being magnesium.

2. A Si-containing magnesium alloy for high pressure casting from a melt thereof to produce a cast alloy part with reduced hot cracking, comprising 6 to 12% by weight of aluminum, 0.3 to 1.5% by weight of silicon, 0.005 to 0.2% by weight of strontium, and from more than 6 to 12% by weight of zinc, the balance being magnesium.

3. A Si-containing magnesium alloy for high pressure casting from a melt thereof to produce a cast alloy part with reduced hot cracking, comprising from more than 10 to 12% by weight of aluminum, 0.3 to 1.5% by weight of silicon, 0.005 to 0.2% by weight of strontium, and 0.01 to 2.0% by weight of zinc, the balance being magnesium.

4. The Si-containing magnesium alloy according to claim 2 or 3, wherein the amount of strontium is from 0.005 to 0.1% by weight.

5. The Si-containing magnesium alloy according to claim 1, 2 or 3, further comprising 0.2 to 0.4% by weight of manganese.

6. The Si-containing magnesium alloy according to claim 1, 2 or 3, further comprising 5 ppm to 0.001% by weight of beryllium.

* * * * *